United States Patent [19]

Sasabe et al.

[11] Patent Number: 5,012,294

[45] Date of Patent: Apr. 30, 1991

[54] MOVABLE GUIDE MEMBER IN A RECEIVING DEVICE OF AN IMAGE FORMING APPARATUS

[75] Inventors: Junya Sasabe, Kobe; Masao Sugimori, Hirakata, both of Japan

[73] Assignee: Mita Industrial Co., Ltd., Osaka, Japan

[21] Appl. No.: 429,418

[22] Filed: Oct. 31, 1989

[30] Foreign Application Priority Data

Nov. 11, 1988 [JP] Japan ..... 63-286309

[51] Int. Cl.[5] ..... G03G 21/00

[52] U.S. Cl. ..... 355/309; 271/127

[58] Field of Search ..... 355/309, 200, 308; 271/126, 127

[56] References Cited

U.S. PATENT DOCUMENTS 3,827,687 8/1974 Kono ..... 271/127 X
4,535,982 8/1985 Mochimaru ..... 271/127
4,699,371 10/1987 Ettischer et al. ..... 271/127
4,900,005 2/1990 Blyth et al. ..... 271/127

*Primary Examiner*—A. T. Grimley
*Assistant Examiner*—William J. Royer
*Attorney, Agent, or Firm*—Beveridge, DeGrandi & Weilacher

[57] ABSTRACT

An image forming apparatus in accordance with the invention includes a body for the device that performs an image forming operation, and a receiving device provided on a rear part of the body, for receiving a paper feeding member. The receiving device includes a guide member which supports the paper feeding member and shifts between a first position where the paper feeding member is in a sharply inclined position, and a second position where the paper feeding member is held in a lowered position. The guide member is designed to shift in response to feeding member insertion, attachment and removal operations such that forces are provided to aid in performing these operations.

11 Claims, 3 Drawing Sheets

PRIOR ART

MOVABLE GUIDE MEMBER IN A RECEIVING DEVICE OF AN IMAGE FORMING APPARATUS

BACKGROUND OF THE INVENTION

1. Field of the Invention

The present invention relates to an image forming apparatus such as an electronic copying machine or a printer etc., and more particularly relates to an image forming apparatus having a structure in which a paper feeding member may be removably attached to a body performing an image forming operation.

2. Description of the Prior Art

As shown in FIG. 1, conventionally, some image forming apparatuses (i.e., electronic copying machines or printers, etc.) generally include such a structure that a paper feed cassette 3 and a by-path table 4 are attached on the opposite side (B) (hereinafter, referred to as "back side") to the operation side (A) where an operation panel 2 of a body 1 which performs the image forming operation is provided.

Further, as shown in FIG. 2, it has been proposed that another cassette, i.e., a feeder cassette 7 is attached on the back side (B) via a feeder 6 in addition to a paper feed cassette 5 to be inserted from the operation side (A). And, there has also been proposed such an apparatus (not illustrated) that the feeder cassette 7 is attached directly on the body 1, not through the feeder 6. For easier understanding, FIG. 3 schematically shows the construction of the image forming apparatus of the type as shown in FIG. 2. In FIG. 3, the shape of the feeder 6 is somewhat modified from that in FIG. 2 so that the feeder cassette 7 may be obliquely attached in consideration of the operating efficiency.

In FIG. 3, Numeral 8 indicates paper feed rollers which guide a paper 9 from the paper feed cassette 5 onto a reversing transport path 10, and Numerals 11, 12, 13 and 14 indicate resist rollers, a printer drum, fix rollers and a discharge tray, respectively. Meanwhile, on the feeder 6 side are provided paper feed rollers 16 by which a paper 15 in the feeder cassette 7 attached to the feeder 6 is guided onto a transport path 17 toward the resist rollers 11. Numeral 18 indicates a spring which raises the front end portion of the paper 15 toward the paper feed roller 16 side.

The by-path table 4 in FIG. 1 and the feeder cassette 7 in FIG. 3 are inserted at a sharp inclination relative to the body 1 and the feeder 6 respectively so that the operation may be performed with facility and each paper may be without fail brought in contact with the paper feed rollers. Thereafter, the by-path table 4 and the feeder cassette 7 are brought down to be positioned in the attached state as shown in FIG. 1 and FIG. 3 respectively, and they are brought from the attached state as shown in FIG. 1 and FIG. 3 into the sharply inclined state again when they are removed.

According to the above-described constructions of the conventional image forming apparatuses, in order to insert the by-path table 4 or the feeder cassette 7 into the body 1 or the feeder 6 respectively and then remove it therefrom, an operator has to turn from the operation side (A) to the back side (B) of the apparatus, this results in more than a little inconvenience to the operator.

Additionally, it is left to operation along a stationary guide member by the operator that the by-path table 4 or the feeder cassette 7 is inserted from a sharply inclined position, brought down into the attached state and lifted again to be removed, therefore it may be said that some practice is required for such operation.

SUMMARY OF THE INVENTION

It is an object of the present invention to provide an image forming apparatus which is constructed in such a manner that on the operation side where the operation panel is installed, a table or cassette for feeding papers can be easily inserted into the side opposite to the operation side, attached thereto and removed therefrom.

Another object of the present invention is to provide an image forming apparatus which is so constructed as to facilitate the insertion, removal and attachment operations of the table or the cassette for feeding papers. According to a first feature of the present invention, the image forming apparatus comprises:

a body for performing an image forming operation; and a receiving device provided on the rear part of the body for attaching a paper feeding member, the receiving device comprising a guide member which supports the paper feeding member while shifting between a first position where the paper feeding member is brought into the sharply inclined position, and a second position where the paper feeding member is kept in the fallen or lowered position.

According to a second feature of the present invention, the image forming apparatus comprises:

a body for performing an image forming operation; and a receiving device provided on the rear part of the body for attaching a paper feeding member, the receiving device comprising;

a movable guide member which supports the paper feeding member while shifting between a first position where the paper feeding member is brought into the sharply inclined position, and a second position where the paper feeding member is kept in the fallen or lowered position, and a stationary guide member provided in opposition to the movable guide member.

According to a third feature of the present invention, the image forming apparatus comprises:

a body for performing an image forming operation;

a paper feeding member which may be removably attached to the body; and a receiving device for attaching the paper feeding member to the body, the receiving device comprising auxiliary means for facilitating displacement action between one position at which the paper feeding member is in the attached state, and the other position at which a paper feeding member insertion or removal operation is performed.

According to a fourth feature of the present invention, the image forming apparatus comprises:

a body for performing an image forming operation;

a feeder for guiding papers into the body one by one; and a paper feeding member which may be removably attached to the feeder; and a receiving device provided on the feeder for attaching the paper feeding member, the receiving device comprising auxiliary means for facilitating displacement action between one position at which the paper feeding member is in the attached state, and the other position at which a paper feeding member insertion or removal operation is performed.

In accordance with the constructions as described above, when a cassette or a table for feeding papers is inserted at a sharp inclination, auxiliary force is added for automatically aiding the cassette or the table in falling down into the attached state. Similarly, when the cassette or the table is raised from the attached state for its removal, an auxiliary force for facilitating this action is added, enabling the removal operation to be performed easily. Here, it should be noted that such actions are smoothly performed by means of the movable guide member.

As described above, the image forming apparatus of the present invention is so constructed that insertion into the back side, attachment thereto and removal therefrom may be easily performed. For this reason, it is made possible to perform the respective operations on the back side from the operation side.

BRIEF DESCRIPTION OF THE DRAWINGS

These and other objects and features of the present invention will become apparent from the following description, taken in conjunction with preferred embodiments thereof, with reference to the accompanying drawings throughout which like parts are designated by like reference numerals, and in which.

DETAILED DESCRIPTION OF THE PREFERRED EMBODIMENTS

Hereinafter, an embodiment of the present invention will be explained with reference to the drawings.

Figure 1:
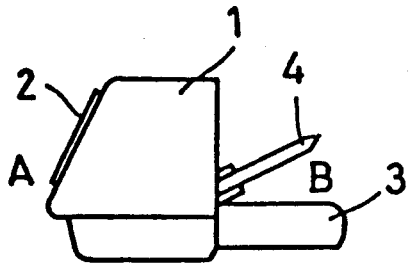
FIG. 1 is a schematic side view of a conventional image forming apparatus.
Figure 2:
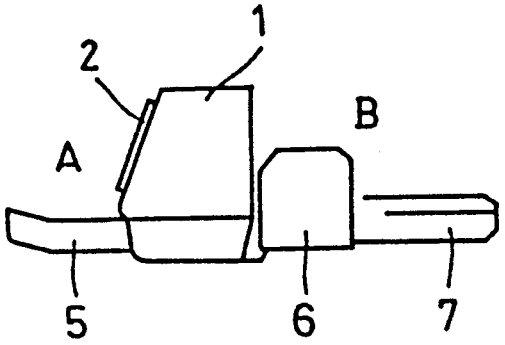
PRIOR ART Fig. 2
FIG. 2 is a schematic side view of another conventional image forming apparatus.
Figure 3:
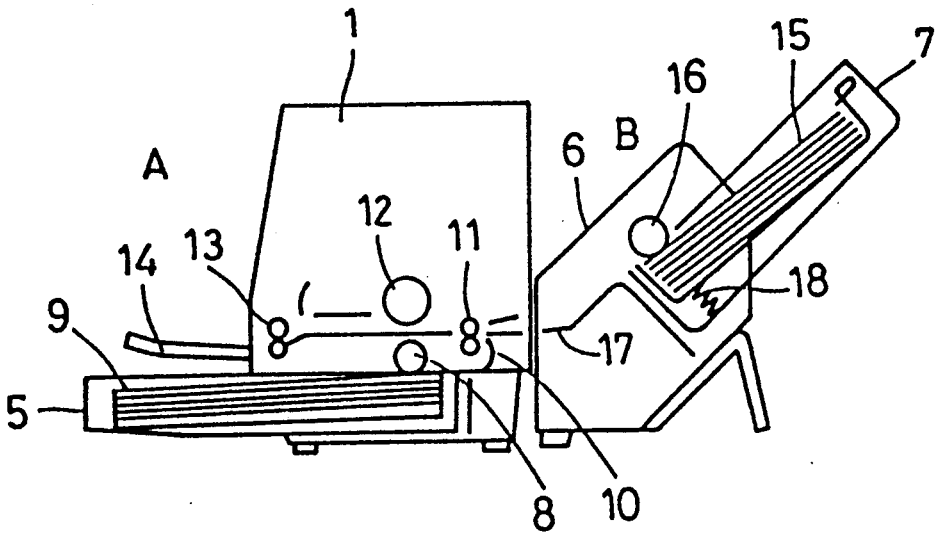
PRIOR ART Fig. 3
FIG. 3 is a schematic sectional side view of an image forming apparatus partially modified from that as shown in FIG. 2.
Figure 4:
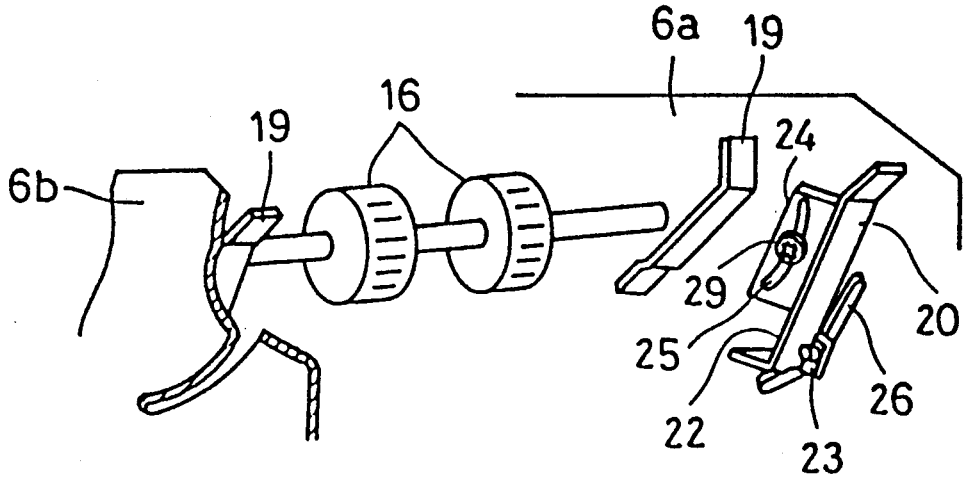
FIG. 4 is a partially cutaway perspective view of an essential portion of an image forming apparatus according to the present invention.

FIG. 4 shows application of the present invention to the image forming apparatus of the type as shown in FIG. 3. In FIG. 4, a stationary first guide member 19 which guides the upper side of the feeder cassette 7 is provided in the vicinity of each end of a shaft of the paper feed rollers 16 on each inner surface of side plates (i.e., stationary support plates) 6*a* and 6*b* of the feeder 6. In addition, on each side plate is provided a slidable second guide member 20 which guides the underside of the feeder cassette 7 as opposed to the first guide member 19. Hereinafter, explanation will be made only with respect to the second guide member 20 mounted on the side plate 6*a*.

Figure 5:
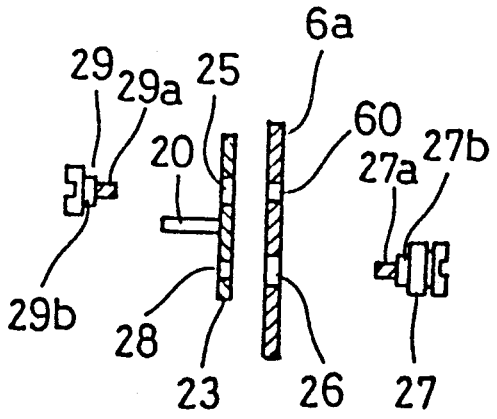
FIG. 5 is an exploded side view showing a part of the image forming apparatus of FIG. 4.
Figure 6A:
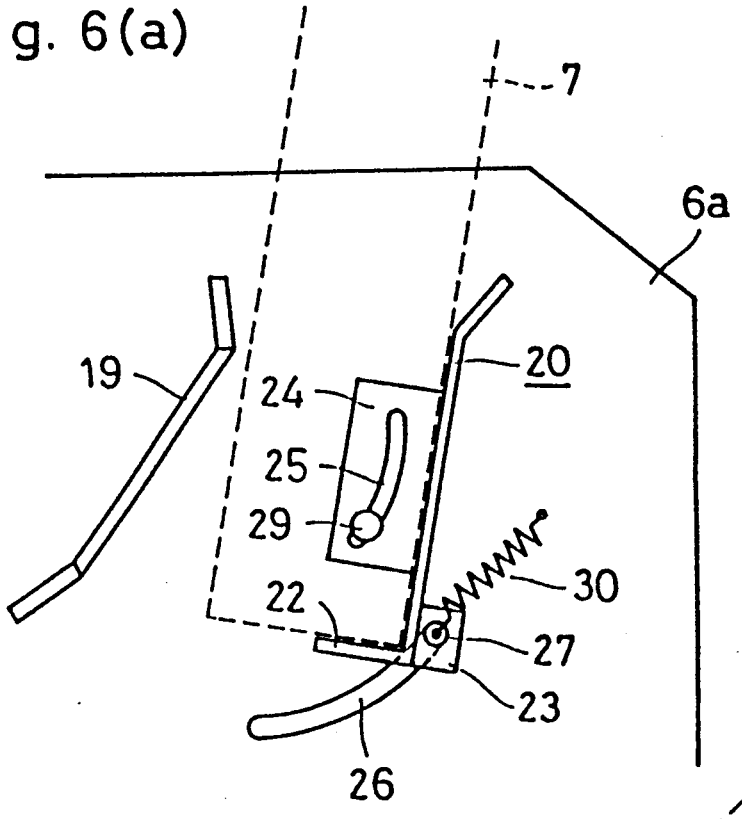
FIGS. 6(*a*) and 6(*b*) are views showing the receiving device for attaching the paper feeding member in the image forming apparatus of FIG. 4.
Figure 6B:
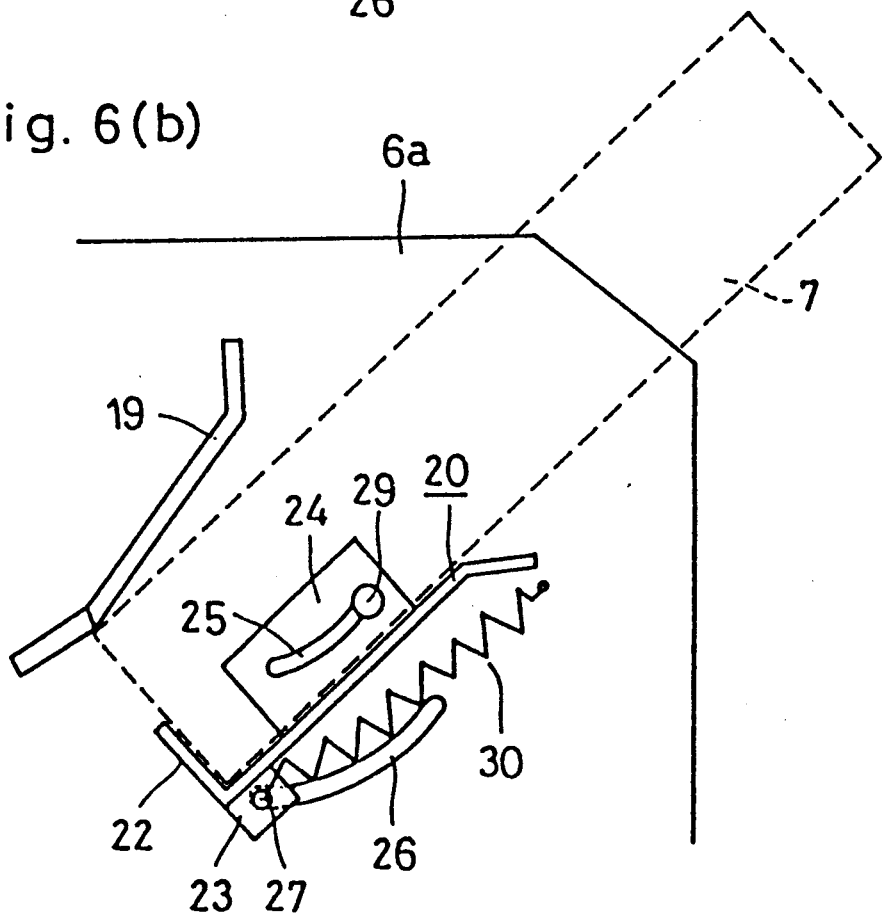

A L-shaped portion 22, a pin support portion 23 and a portion 24 having a slide slot 25 constitute the second guide member 20, which is, as shown in FIG. 5, mounted on the side plate 6*a* in the following manner: A screw portion 27*a* of a first pin 27 is screwed into a tapped hole 28 of the pin support portion 23 from the outside of the side plate 6*a* through a guide slot 26 formed thereon, as sandwiching the side plate 6*a*. At this time, a slide portion 27*b* of the first pin 27 is slidably fit in the guide slot 26. Thus, a first slide mechanism is constituted with the first pin 27 screwed into the tapped hole 28 of the pin support portion 23, and the guide slot 26. On the other hand, a screw portion 29*a* of a second pin 29 is screwed into a tapped hole 60 of the side plate 6*a* through the slide slot 25 as sandwiching the portion 24 having the slide slot 25, and the slide slot 25 slides relative to a slide portion 29*b* of the second pin 29. Thus, a second slide mechanism is constituted with the above-mentioned portion 24 and the second pin 29. The first pin 27 is, as shown in FIG. 6(*a*), given obliquely upward biasing force by a spring member 30, therefore when the feeder cassette 7 is not inserted, the second guide member 20 slides to the top end of the guide slot 26 and brought into a raised state. The guide slot 26 is bow shaped, drawing an arc from the top end to the bottom, while the slide slot 25 takes shape of a bow or a straight line.

Next, the action of the second guide member 20 will be explained with reference to FIGS. 6(*a*) and 6(*b*). When the feeder cassette 7 is not inserted, the second guide member 20 remains lifted up due to the spring member 30 as shown in FIG. 6(*a*). Accordingly, in this state, insertion of the feeder cassette 7 is performed from substantially just above. The insertion brings one end portion of the feeder cassette 7 in contact with the base of the L-shaped portion 22, with the result that the second guide member 20 is shifted downward against the upward biasing force of the spring member 30 because of the weight of the feeder cassette 7. At this time, the slide portion 27*b* of the first pin 27 secured to the second guide member 20 slides downward along the guide slot 26 of the side plate 6*a*. Simultaneously, the slide slot 25 of the second guide member 20 is slides downward while contacting the slide portion 29*b* of the second pin 29 which is fixed to the side plate 6*a* through the second guide member 20. As a result, the second guide member 20 falls into the position shown in FIG. 6(*b*), and in this position, attachment of the feeder cassette 7 is completed. At this position, the upper front end of the feeder cassette 7 is brought into contact with the first guide member 19, therefore the feeder cassette 7 remains in the stopped position against such force as to rotate in the counterclockwise direction, relative to the first pin 27 due to its weight.

Next, when the feeder cassette 7 in the position as shown in FIG. 6(*b*) is removed from the feeder 6, the second guide member 20 is shifted upwardly in response to the upward force which is added at the time of the removal of the feeder cassette 7. In this case, the spring member 30 actuates so as to facilitate the upward motion of the second guide member 20. The feeder cassette 7 is thus smoothly brought to the position as shown in FIG. 6(*a*) to be easily removed.

As described above, the second guide member 20 shifts between the positions as shown in FIGS. 6(*a*) and 6(*b*) in response to the insertion, attachment and removal of the feeder cassette 7, therefore during such displacement actions of the second guide member 20, a promoting force is designed to be added for facilitating smooth insertion, attachment and removal operations. Consequently, the feeder cassette 7 can be conveniently inserted into and removed from the back side of the image forming apparatus by the operation on this operation, side.

In the above-described embodiment, only the case of attaching the feeder cassette 7 is explained, however, not limited thereto, the above construction is similarly applicable for the by-pass table or for other paper feed cassettes. Additionally, though the movable second guide member 20 and the spring member 30 and so on are adopted as auxiliary means in the present embodiment, another mechanism may be utilized in place of them.

Although the present invention has been fully described by way of example with reference to the accompanying drawings, it is to be noted here that various changes and modifications will be apparent to those skilled in the art. Therefore, unless such changes and modifications otherwise depart from the scope of the present invention, they should be construed as being included therein.

What is claimed is:

1. An image forming apparatus comprising:

a body for performing an image forming operation; and a receiving device provided on the rear part of the body for receiving a paper feeding member, the receiving device comprising a guide member which supports a received paper feeding member as the guide member shifts between a first position wherein the paper feeding member is brought into a sharply inclined position, and a second position wherein the paper feeding member is held in a lowered position, and spring means for biasing the guide member to the first position when the guide member is not supporting a received paper feeding member and for biasing the guide member against the weight of a received paper feeding member when the guide member is brought into the second position due to the weight of the paper feeding member.

2. An image forming apparatus as claimed in claim 1, in which the receiving device further comprises a stationary support plate having a bowed guide slot formed therein, and a pin provided on the guide member for being inserted into the guide slot.

3. An image forming apparatus as claimed in claim 2, in which the spring means is fixed at its ends to the support plate and the pin respectively.

4. An image forming apparatus as claimed in claim 1, in which the receiving device further comprises a stationary support plate and a pin provided on the stationary support plate, the guide member having a bowed guide slot formed therein for receiving the pin.

5. An image forming apparatus including a body for performing an image forming operation, and a receiving device provided on the rear part of the body for receiving a paper feeding member, the receiving device comprising:

a guide member which supports a received paper feeding member as the guide member shifts between a first position wherein the paper feeding member is brought into a sharply inclined position for insertion or removal of the paper feeding member, and a second position wherein the paper feeding member is held in a lowered position; and means for automatically keeping the guide member at the first position in the absence of a paper feeding member.

6. An image forming apparatus as claimed in claim 5, in which the paper feeding member is a paper feed cassette.

7. An image forming apparatus as claimed in claim 5, in which the paper feeding member is a paper feed tray.

8. An image forming apparatus as claimed in claim 5, in which the body comprises an electronic copying machine.

9. An image forming apparatus as claimed in claim 5, in which the body comprises a printer.

10. An image forming apparatus as claimed 15, in which the rear part of the body is a paper feeder.

11. An image forming apparatus comprising:

a body for performing an image forming operation; and a receiving device provided on the rear part of the body for attaching a paper feeding member, the receiving device comprising:

a movable guide member which supports a paper feeding member as the guide member shifts between a first position wherein the paper feeding member is brought into a sharply inclined position for insertion or removal of the paper feeding member, and a second position wherein the paper feeding member is held in a lowered position, means for automatically keeping the guide member at the first position in the absence of an attached paper feeding member, and a stationary guide member provided in opposition to the movable guide member.

* * * * *